US009428713B2

(12) United States Patent
Tyson

(10) Patent No.: US 9,428,713 B2
(45) Date of Patent: Aug. 30, 2016

(54) OIL CANDLE WITH INTEGRATED FRAGRANCE DECK

(71) Applicant: G. Philip Tyson, Sarasota, FL (US)

(72) Inventor: G. Philip Tyson, Sarasota, FL (US)

( * ) Notice: Subject to any disclaimer, the term of this patent is extended or adjusted under 35 U.S.C. 154(b) by 120 days.

(21) Appl. No.: 14/458,191

(22) Filed: Aug. 12, 2014

(65) Prior Publication Data

US 2016/0046889 A1 Feb. 18, 2016

(51) Int. Cl.
*C11C 5/00* (2006.01)

(52) U.S. Cl.
CPC ..... *C11C 5/002* (2013.01); *C11C 5/006* (2013.01); *C11C 5/008* (2013.01)

(58) Field of Classification Search
CPC ..... F23D 3/02; F23D 3/18; F21V 35/00; C11C 5/00
USPC ..... 44/275
See application file for complete search history.

(56) References Cited

U.S. PATENT DOCUMENTS 4,892,711 A 1/1990 Tendick
5,840,257 A 11/1998 Bureau
5,911,955 A 6/1999 Fullam
6,152,728 A 11/2000 Griffel
6,159,002 A * 12/2000 LeJeune ..... F23D 3/34 431/321
6,290,914 B1 9/2001 LeJeune
6,333,009 B1 12/2001 Allison
6,347,879 B1 * 2/2002 Prado ..... F21V 37/00 362/157
6,426,051 B1 7/2002 Allison
6,508,644 B1 * 1/2003 Pesu ..... F21V 37/00 431/288
6,579,090 B1 * 6/2003 Taubitz ..... F23D 3/08 431/126
6,918,681 B2 * 7/2005 Brizzie ..... F21V 37/00 362/161
6,923,639 B2 * 8/2005 Pesu ..... C11O 5/006 431/288
6,960,320 B1 11/2005 Smith
6,991,453 B2 1/2006 Decker
7,546,668 B2 * 6/2009 Strelnieks ..... B29C 67/241 249/91
7,568,913 B2 8/2009 Decker
8,062,389 B2 * 11/2011 Pisklak ..... C10L 1/02 44/308
8,693,852 B2 4/2014 Baraky
2003/0108461 A1 6/2003 Lo
2007/0237688 A1 10/2007 Walker
2009/0291400 A1 * 11/2009 Levy ..... F23D 3/18 431/120
2012/0077133 A1 * 3/2012 Cagle ..... C11O 5/002 431/291
2012/0171631 A1 7/2012 Patterson
2013/0029276 A1 * 1/2013 Gerhardt ..... F23D 3/18 431/320
2013/0129571 A1 5/2013 Chiu

* cited by examiner

*Primary Examiner* — Ellen McAvoy
(74) *Attorney, Agent, or Firm* — IDP Patent Services; Olav M. Underdal

(57) ABSTRACT

An oil candle with integrated aroma deck includes a candle main body, further including a fuel reservoir, an aroma deck with an aroma deck aperture, a flame shield, and aroma deck shoulder, a wick and a wick collar, such that the wick collar is inserted in place in the aroma deck aperture, with the wick extending into the fuel reservoir. The oil candle is refillable with lighting oil, and provides flame protection via the flame shield. The aroma deck is designed to hold a small amount of aromatic oil, which is warmed by a flame from the burning wick, and thereby emits a pleasant fragrance. The flame shield, aroma deck, and fuel reservoir can be made from borosilicate glass or other heat resistant materials. The oil candle can further include an inward protruding rim, and a snap-on cover with an attached wick collar cover.

20 Claims, 8 Drawing Sheets

OIL CANDLE WITH INTEGRATED FRAGRANCE DECK

CROSS-REFERENCE TO RELATED APPLICATIONS

N/A

FIELD OF THE INVENTION

The present invention relates generally to the field of oil lamps and candles, and more particularly to oil candles with inbuilt fragrance delivery.

BACKGROUND OF THE INVENTION

Oil lamps and candles have been used for lighting purposes since ancient times. While before the advent of electricity, they were an important alternative to candles, in the modern age they mainly remain popular for the ambience associated with their use. For establishments that seek to promote a natural ambience associated with candle lighting, refillable oil candles can be more economical and easier to use than traditional wax based candles.

Oil lamps and candles can furthermore include devices or methods for delivering an aromatic fragrance during their use. This can include using a special lighting oil that includes aromatic elements. However, such special fragrant fuel oil compositions can be expensive, and may produce excess soot or have other undesirable characteristics.

Other designs use special chambers for containing aromatic oil, which is typically heated by a burning wick, and dispenses a fragrance upon heating of the aromatic oil. However, these devices are often bulky and they are typically designed so that the aromatic oil is above the lighted wick, such that the aromatic oil becomes very hot. Consequently, these types of designs can be both impractical, expensive, and dangerous in case of an accidental spill.

As such, considering the foregoing, it may be appreciated that there continues to be a need for novel and improved devices and methods for design of oil candles with integrated fragrance delivery.

SUMMARY OF THE INVENTION

The foregoing needs are met, to a great extent, by the present invention, wherein in aspects of this invention, enhancements are provided to the existing models for combining an oil candle with a mechanism for aromatic oil based fragrance delivery.

In an aspect, an oil candle with integrated aroma deck functions as a one-piece refillable oil candle with a recessed fuel vessel, which utilizes a glass aroma deck with an aluminum wick collar, wick and flame shield. The fuel deck has a raised opening for the aluminum wick collar to rest while holding the wick. The aroma deck is designed to hold small amounts of fragrance oils that are warmed by the flame increasing the fragrance.

In a related aspect, the aroma deck shoulder functions to support the wick collar, enclose a basin for fragrance oils, prevent any leakage of fragrance oils into the fuel, and prevent fragrance oils coming in contact with the aluminum wick collar.

In a further related aspect, the oil candle with integrated aroma deck encompasses a single structure that contains a fuel reservoir, opening for wick collar and wick, aroma deck for throwing fragrance, and a flame shield in the form of extended upper walls that provide flame and wind protection.

In a yet a further related aspect, the oil candle with integrated aroma deck provides flame protection, fragrance throw capabilities, attractive lighting, easy refilling, a large reservoir for extended burn times, viewable fuel level, and safe operation.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
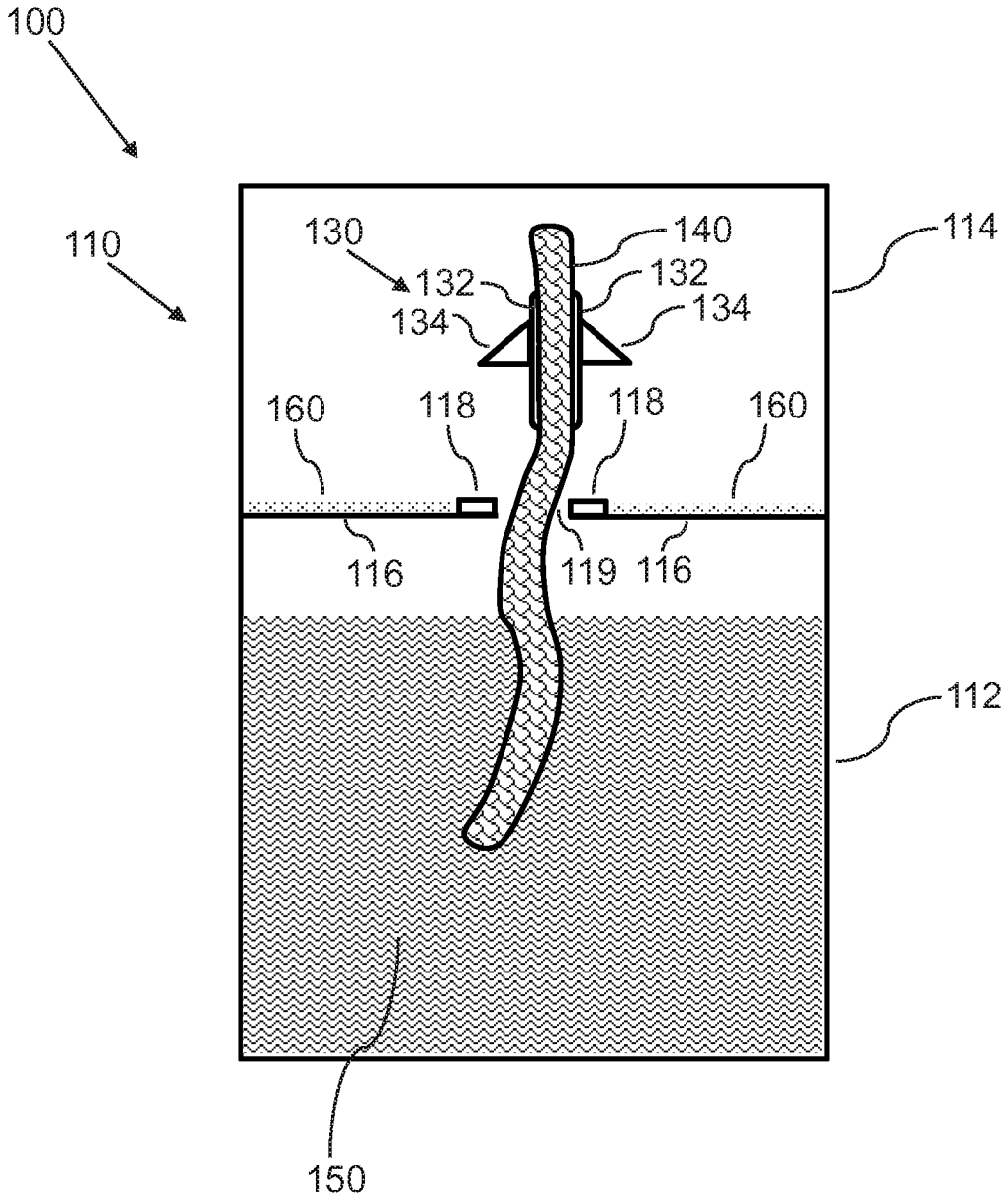
FIG. 1 is a cross-sectional schematic diagram illustrating an oil candle with integrated aroma deck, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of an oil candle with integrated aroma deck 100 with reference to FIG. 1, in such manner that like reference numerals refer to like components throughout; a convention that we shall employ for the remainder of this specification.

In an embodiment, an oil candle with integrated aroma deck 100 can comprise:

a) A candle main body 110; which further comprises:
   i. A fuel reservoir 112; which can contain a liquid fuel 150, such as a lamp oil;
   ii. An aroma deck 116; positioned on top of the fuel reservoir 112, such that it closes the fuel reservoir, such that the aroma deck 116 further comprises an aroma deck aperture 119;
   iii. A flame shield 114, connected to the top of the fuel reservoir 112;
   iv. An aroma deck shoulder 118, which is a ridge that protrudes from the aroma deck 116, around the aroma deck aperture 119, such that the aroma deck 116 is encased by the flame shield 114, and the aroma deck shoulder 118, and thereby forms a shallow basin that can hold an aromatic liquid 150, such as an aromatic oil;

b) A wick 140;

c) A wick collar 130; further comprising:
   i. A collar body 132, which can be an elongated hollow structure, for example in the form of a follow cylinder, further comprising a collar aperture through which the wick 130 can be mounted;
   ii. A collar flange 134, which is mounted around the collar body 132, such that collar flange 134, can rest on top of the aroma deck shoulder 118, with the wick collar 130 inserted through the aroma deck aperture 119.

In a related embodiment, the wick collar 130 can be made from one piece, with a central collar aperture through a collar body 132, which further includes a shape configured to be a collar flange 134.

Figure 2:
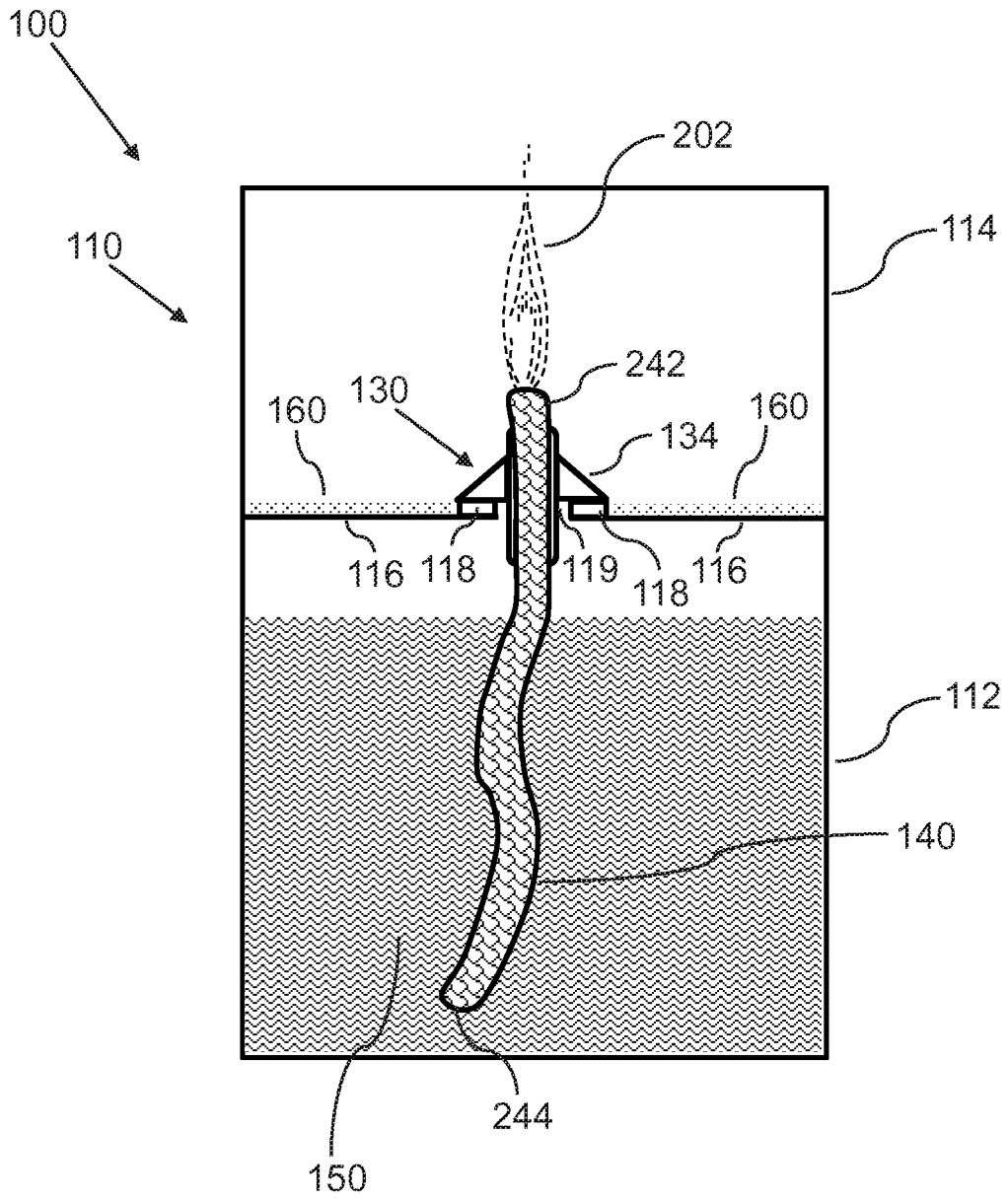
FIG. 2 is a cross-sectional schematic diagram illustrating an oil candle with integrated aroma deck, according to an embodiment of the invention.

FIG. 2 illustrates the embodiment of FIG. 1 wherein the wick collar 130 with a wick 140 is installed in the aroma deck aperture 119, such that the collar flange 134 rests on top of the aroma deck shoulder 118, with a lower part of the wick collar 130 inserted through the aroma deck aperture 119, such that the lower end 244 of the wick 140 is embedded in the liquid fuel 150, and a flame 202 can burn from the upper end 242 of the wick 140, which protrudes through an upward facing side of the wick collar 130.

Figure 3:
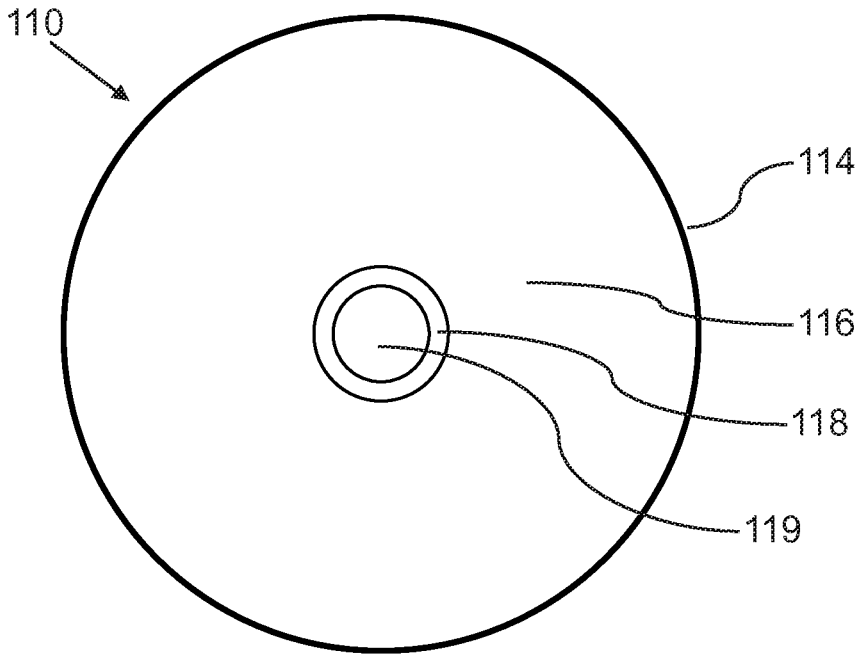
FIG. 3 is a top view schematic diagram illustrating an oil candle with integrated aroma deck, according to an embodiment of the invention.

In a related embodiment, FIG. 3 shows a top view of the aroma deck 116 encased by the flame shield 114 on an outer periphery, and the aroma deck shoulder 118 on an inner periphery.

FIG. 3 shows the aroma deck aperture 119 in a center point location of the aroma deck. In alternative embodiments, the aroma deck aperture 119 may be in an off-center position.

FIG. 3 shows a circular shape of the candle main body 110, as seen from a top cross-sectional view, such that each of the flame shield, aroma deck, and fuel reservoir are circular. In alternative embodiments, the shape may be quadratic, rectangular, oval, or some other curved or pointed shape.

Figure 4:
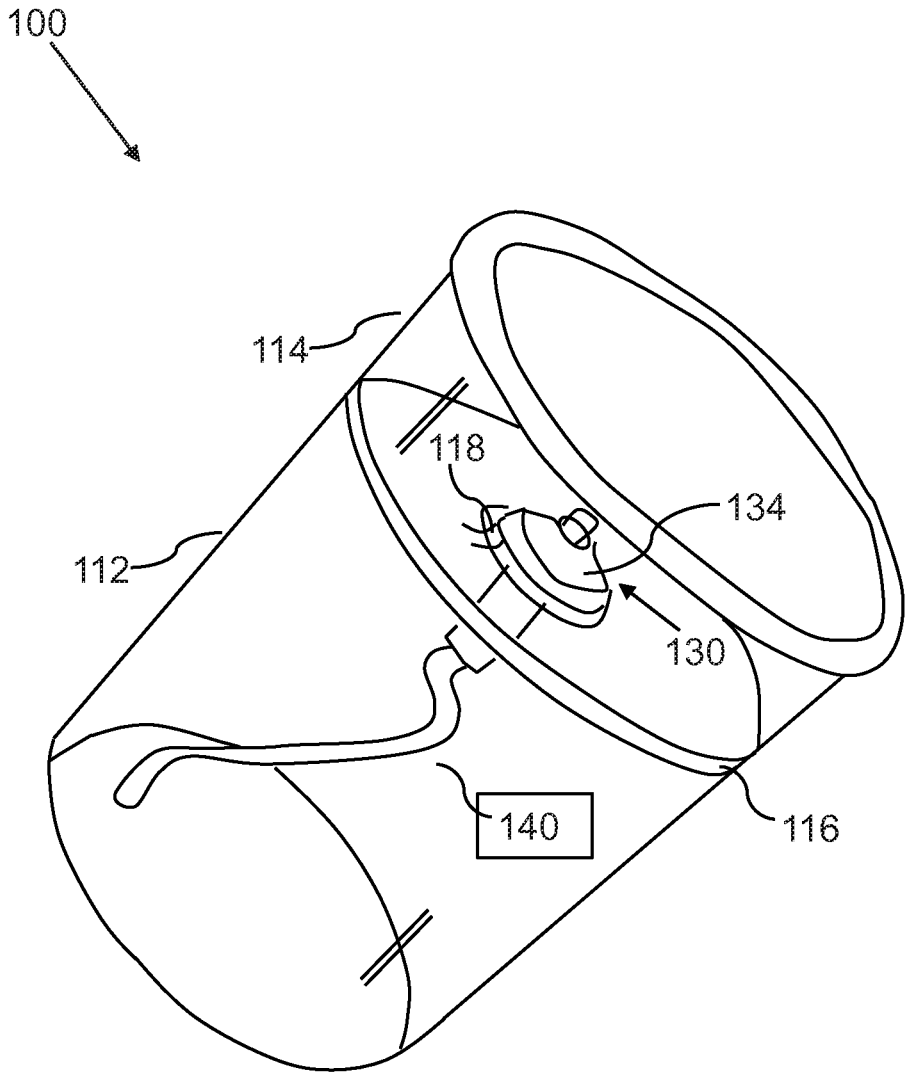
FIG. 4 is a perspective view illustrating an oil candle with integrated aroma deck, according to an embodiment of the invention.

In a related embodiment, FIG. 4 illustrates a perspective view of an oil candle with integrated aroma deck 100, wherein the wick collar 130 with a wick 140 is installed in the aroma deck aperture 119 (not visible), such that the collar flange 134 rests on top of the aroma deck shoulder 118, with the wick collar 130 inserted through the aroma deck aperture 119 (not visible), such that the lower end of the wick 140 is inside the fuel reservoir 112.

Figure 5:
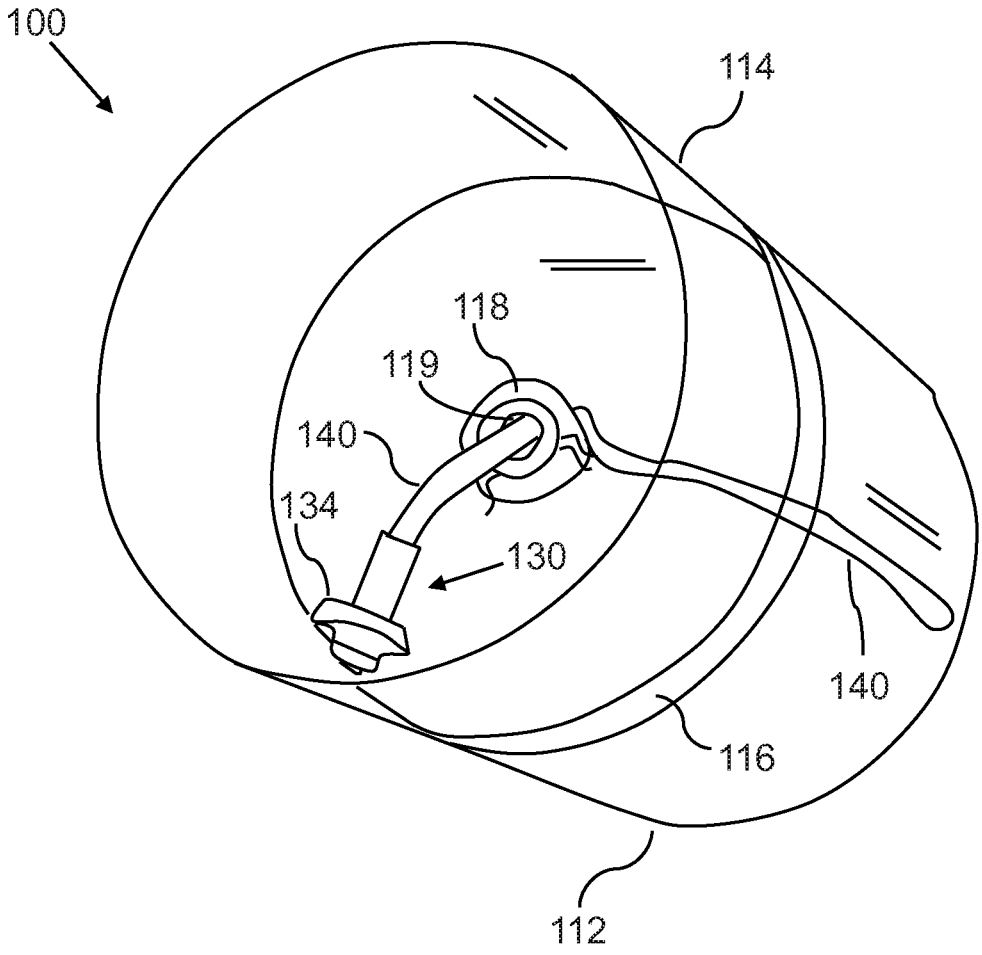
FIG. 5 is a perspective view illustrating an oil candle with integrated aroma deck, according to an embodiment of the invention.

In a related embodiment, FIG. 5 illustrates a perspective view of an oil candle with integrated aroma deck 100, before the wick collar 130 with a wick 140 is installed in the aroma deck aperture 119, with the wick 140 inserted through the aroma deck aperture 119, such that the lower end of the wick 140 is inside the fuel reservoir 112.

In various embodiments, the flame shield 114, aroma deck 116, and fuel reservoir 112, can each be made of an opaque material, such as ceramic or a metal, or transparent material, such as glass. FIGS. 4 and 5 show an embodiment, wherein the flame shield 114, aroma deck 116, and fuel reservoir 112 are transparent, made from a heat resistant glass.

In related embodiments, the flame shield 114, aroma deck 116, and fuel reservoir 112 can be manufactured using borosilicate glass, in the form of heat resistant compositions of glass including silica and boron trioxide, available under a plurality of trade names, such as Borcam, Borosil, Suprax, Kimax, Pyrex, Endural, Schott, and Refmex.

The wick collar 130 can be made from a ceramic, borosilicate glass, brass, aluminum, stainless steel, or other heat resistant material.

In further related embodiments the wick collar 130 can be made from a heat resistant material with low thermal conductivity, including a ceramic material such as the cubic crystalline form of zirconium dioxide, whereby transfer of heat from a burning wick 140 to the aroma deck 116 is reduced, such that heating of the aromatic liquid 150 mainly happens via heat radiation from a flame of the burning wick 140, thereby heating an upper surface of the aromatic liquid 150, which causes an increased evaporation of the aromatic liquid 150, without excessive heating of the aromatic liquid 150. A low thermal conductivity can be below 5 watts per meter kelvin. Heat resistant materials include materials tolerant to exposure up to at least 600 degrees Celsius.

In an embodiment, the aroma deck 116 and the aroma deck shoulder 118 can be made from one piece of material. For example the aroma deck shoulder 118, can be formed from one piece of molten glass during manufacturing, such that the aroma deck is made of one disk shaped glass, wherein a ridge is formed from the glass around a central aperture, thereby creating an aroma deck shoulder 118, enclosing an aroma deck aperture 119.

Figure 6:
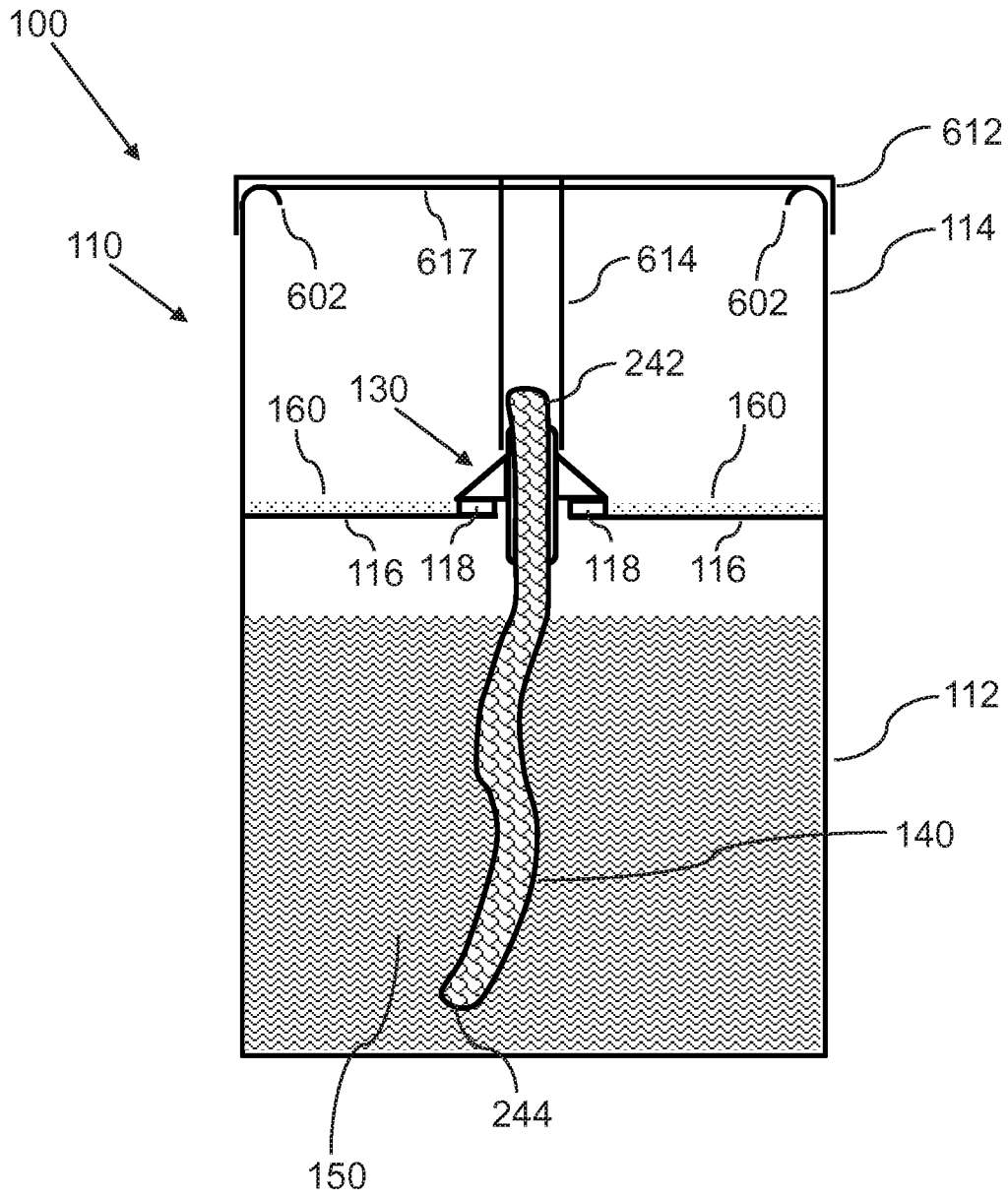
FIG. 6 is a cross-sectional schematic diagram illustrating an oil candle with integrated aroma deck, according to an embodiment of the invention.

In an embodiment, illustrated in FIG. 6, the upper rim 617 of the flame shield 114 can be connected to a protruding rim 602 that protrudes inwards and downwards from the upper rim 617 of the flame shield 114, which can serve to contain the aromatic liquid 150 in case the oil candle with integrated aroma deck 100 is accidentally toppled over during use. The inward protruding rim 602 can be a softly curved part of the flame shield formed in glass, as shown, or it can be a separate structure.

In a related embodiment, the oil candle with integrated aroma deck 100 can further include a snap-on cover 612, which can snap on the top 617 of the flame shield 114, for storage or transportation. Related to this, a wick collar cover 614, can be connected to and protrude downward from the snap-on cover 612 and covers the wick collar 130 and wick 140, thereby securing the wick collar 130 and wick 140 in place. As shown the wick collar cover 612 can for example be an elongated hollow cylinder. The wick collar cover can also serve as a convenient tool for extinguishing a burning wick 140.

In a related embodiment a plug can be used to close the aroma deck aperture without a wick collar 130 and wick 140 installed, for example to secure it for transportation, such that the plug can be a stopper to prevent fuel leakage.

Figure 7:
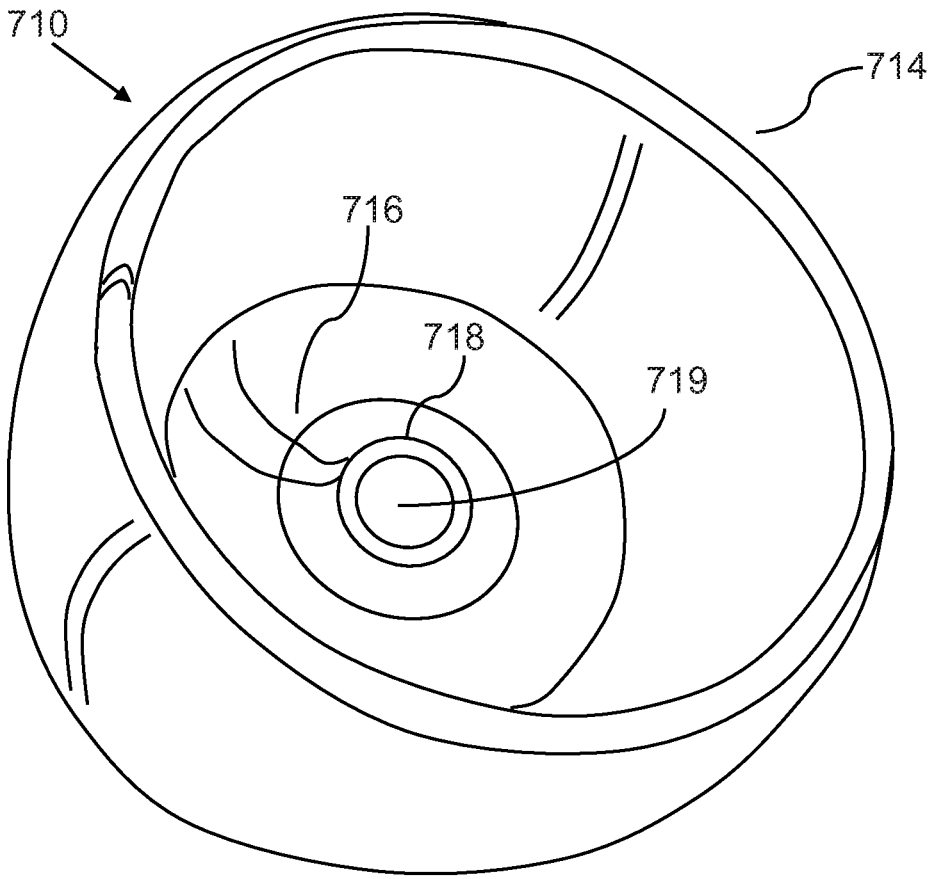
FIG. 7 is an upper perspective view of an example embodiment of a candle main body.

FIG. 7 shows an upper perspective view of an example embodiment of a candle main body 710, manufactured in a double wall glass construction utilizing softly rounded curves. The aroma deck shoulder 718 is formed as part of the aroma deck 716 glass construction. Also showing are the curved flame shield 714, and the aroma deck aperture 719.

Figure 8:
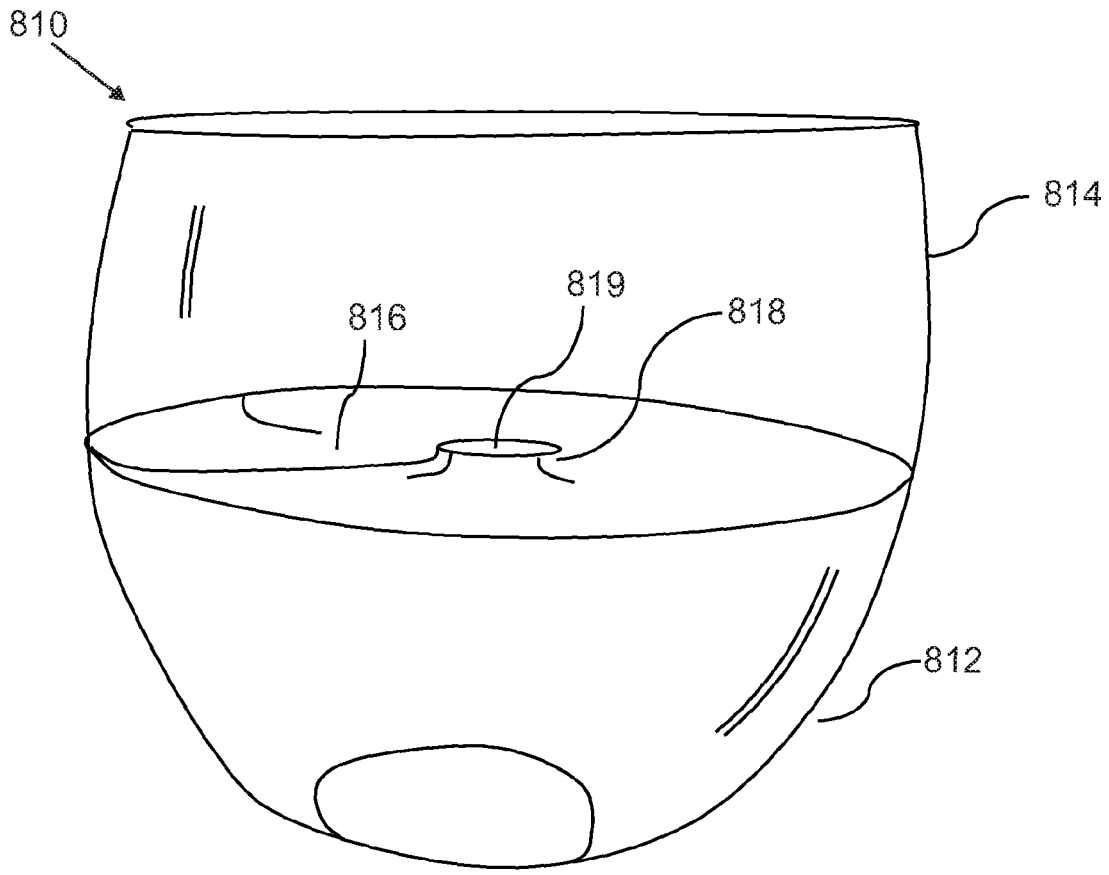
FIG. 8 is a side perspective view of another example embodiment of a candle main body.

FIG. 8 shows a side perspective view of another example embodiment of a candle main body 810, manufactured in a single wall glass construction utilizing softly rounded curves. The aroma deck shoulder 818 is formed as part of the aroma deck 816 glass construction. Also showing are the curved flame shield 814, and the aroma deck aperture 819.

Both FIGS. 7 and 8 show embodiments where the fuel reservoir 812 and the flame shield 714 814 are parts of one integral structure.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. An oil candle with integrated aroma deck, comprising:

a. a candle main body, which further comprises:

i. a fuel reservoir, for containing a liquid fuel;

ii. an aroma deck, connected to a top of the fuel reservoir, such that it closes the fuel reservoir, wherein the aroma deck further comprises an aroma deck aperture;

iii. a flame shield, connected to the top of the fuel reservoir, such that the flame shield surrounds the aroma deck aperture;

iv. an aroma deck shoulder, which is a ridge that protrudes from the aroma deck, surrounding the aroma deck aperture, such that the aroma deck is encased by the flame shield, and the aroma deck shoulder, thereby forming a basin for holding an aromatic liquid;

b. a wick;

c. a wick collar, further comprising:

i. a collar body, further comprising a collar aperture for inserting the wick through;

ii. a collar flange, which is mounted around the collar body;

wherein the collar flange rests on top of the aroma deck shoulder, with a lower part of the wick collar inserted through the aroma deck aperture, such that a lower end of the wick is inside the fuel reservoir, and an upper end of the wick protrudes through an upward facing side of the wick collar.

2. The oil candle with integrated aroma deck of claim 1, wherein a depth of the basin, equal to a protrusion of the aroma deck shoulder above the aroma deck, is in a range from 2 to 10 mm.

3. The oil candle with integrated aroma deck of claim 1, wherein the flame shield, aroma deck, and fuel reservoir are each made of an opaque material.

4. The oil candle with integrated aroma deck of claim 1, wherein the flame shield, aroma deck, and fuel reservoir are each made of borosilicate glass.

5. The oil candle with integrated aroma deck of claim 1, wherein the aroma deck and the aroma deck shoulder are made from one piece of material.

6. The oil candle with integrated aroma deck of claim 1, wherein the aroma deck aperture is in a center point location of the aroma deck.

7. The oil candle with integrated aroma deck of claim 1, wherein each of the flame shield, aroma deck, and fuel reservoir are circular.

8. The oil candle with integrated aroma deck of claim 1, wherein the wick collar is made from a material selected from the group consisting of borosilicate glass, aluminum, brass, ceramics, stainless steel, and combinations thereof.

9. The oil candle with integrated aroma deck of claim 1, wherein the wick collar is made from a heat resistant material with thermal conductivity below 5 watts per meter kelvin.

10. The oil candle with integrated aroma deck of claim 9, wherein the wick collar is made from cubic crystalline zirconium dioxide.

11. The oil candle with integrated aroma deck of claim 1, further comprising an inward protruding rim connected to an upper rim of the flame shield, such that the inward protruding rim protrudes inwards and downwards from the upper rim of the flame shield, whereby the inward protruding rim serves to contain the aromatic liquid when the oil candle with integrated aroma deck is toppled over.

12. The oil candle with integrated aroma deck of claim 1, further comprising a snap-on cover, which snaps on a top of the flame shield.

13. The oil candle with integrated aroma deck of claim 12, further comprising a wick collar cover, configured as an elongated hollow cylinder which is connected to the snap-on cover and protrudes downward from the snap-on cover, and covers the wick collar and wick, whereby the wick collar cover extinguishes a flame of the wick and secures the wick collar and wick in place.

14. An oil candle with integrated aroma deck, comprising:

a. a fuel reservoir, for containing a liquid fuel;

b. an aroma deck, connected with the fuel reservoir, further comprising an enclosed basin, which is open on top, for containing an aromatic liquid;

c. a wick; and d. a wick collar, such that the wick extends through the wick collar, and the wick collar is mounted above the fuel reservoir with a lower end of the wick extending into the liquid fuel in the fuel reservoir, and an upper end of the wick protrudes through the wick collar;

wherein the basin is positioned below a flame from the upper end of the wick, whereby the flame provides ambient light and the aromatic liquid is heated by thermal radiation from the flame, thereby emitting a fragrance.

15. The oil candle with integrated aroma deck of claim 14, wherein a depth of the basin is in a range from 2 to 10 mm.

16. The oil candle with integrated aroma deck of claim 14, further comprising a flame shield mounted on top of the fuel reservoir, such that it encloses the upper end of the wick.

17. The oil candle with integrated aroma deck of claim 14, wherein the wick collar is made from a heat resistant material with thermal conductivity below 5 watts per meter kelvin.

18. The oil candle with integrated aroma deck of claim 16, further comprising an inward protruding rim connected to an upper rim of the flame shield, such that the inward protruding rim protrudes inwards and downwards from the upper rim of the flame shield, whereby the inward protruding rim serves to contain the aromatic liquid when the oil candle with integrated aroma deck is toppled over.

19. The oil candle with integrated aroma deck of claim 16, further comprising a snap-on cover, which snaps on a top of the flame shield.

20. The oil candle with integrated aroma deck of claim 19, further comprising a wick collar cover, configured as an elongated hollow cylinder which is connected to the snap-on cover and protrudes downward from the snap-on cover, and covers the wick collar and wick, whereby the wick collar cover extinguishes a flame of the wick and secures the wick collar and wick in place.

* * * * *